US009176412B2

(12) United States Patent
Sakamoto

(10) Patent No.: US 9,176,412 B2
(45) Date of Patent: Nov. 3, 2015

(54) TWO-COMPONENT DEVELOPER

(71) Applicant: KYOCERA DOCUMENT SOLUTIONS INC., Osaka (JP)

(72) Inventor: Noriaki Sakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/080,651

(22) Filed: Nov. 14, 2013

(65) Prior Publication Data

US 2014/0134530 A1 May 15, 2014

(30) Foreign Application Priority Data

Nov. 15, 2012 (JP) ..... 2012-251261

(51) Int. Cl.
*G03G 9/113* (2006.01)
*G03G 9/097* (2006.01)

(52) U.S. Cl.
CPC ..... *G03G 9/1135* (2013.01); *G03G 9/09741* (2013.01); *G03G 9/09775* (2013.01)

(58) Field of Classification Search
CPC ..... G03G 9/09741; G03G 9/1135
USPC ..... 430/111.35, 111.32, 108.22
See application file for complete search history.

(56) References Cited

U.S. PATENT DOCUMENTS 4,397,935 A * 8/1983 Ciccarelli et al. ..... 430/111.35
5,393,631 A * 2/1995 Horikoshi et al. ..... 430/111.1
5,665,507 A 9/1997 Takagi et al.
2005/0074608 A1* 4/2005 Sawada et al. ..... 428/388
2009/0297974 A1* 12/2009 Kojima et al. ..... 430/111.1
2010/0248113 A1 9/2010 Uemura et al.

FOREIGN PATENT DOCUMENTS

JP H04-204550 A 7/1992
JP 06118723 A * 4/1994 ..... G03G 9/113
JP 06273982 A * 9/1994 ..... G03G 9/113
JP 2002-148869 A 5/2002
JP 2006-163373 A 6/2006
JP 2010-237312 A 10/2010

OTHER PUBLICATIONS

English language machine translation of JP 06-118723 (Apr. 1994).*
English language machine translation of JP 06-273982 (Sep. 1994).*
Anderson, J.H. "The effects of additives on the triboelectric charging of electrophotographic toners" Journal of Electrostatics 37, pp. 197-209 (1996).*

* cited by examiner

*Primary Examiner* — Christopher Rodee
(74) *Attorney, Agent, or Firm* — Studebaker & Brackett PC

(57) ABSTRACT

Two-component developer includes positively chargeable toner and a carrier. The carrier is formed of a carrier core and a coating layer that covers the carrier core. The coating layer includes one or more types of fluorine-containing resin selected from the group consisting of fluorine containing polyimide resin and fluorine containing polyamide-imide resin. The positively chargeable toner includes binder resin and a charge control agent. A content of the charge control agent is 1.0% by mass or higher and 5.0% by mass or lower relative to a mass of the toner.

5 Claims, No Drawings

TWO-COMPONENT DEVELOPER

INCORPORATION BY REFERENCE

The present application claims priority under 35 U.S.C. §119 to Japanese Patent Application No. 2012-251261, filed Nov. 15, 2012. The contents of this application are incorporated herein by reference in their entirety.

BACKGROUND

The present disclosure relates to two-component developer.

In general, in electrophotography, after the surface of a photosensitive drum is electrostatically charged by corona charging or the like, exposure using a laser or the like is performed to form an electrostatic latent image. Then, the formed electrostatic latent image is developed with toner to form a toner image. Further, the formed toner image is transferred to a recording medium, thereby obtaining a high-quality image. In forming the toner image, toner particles (toner base particles) with an average particle diameter of 5 μm or larger and 10 μm or smaller are used usually. Such toner base particles can be obtained through mixing of binder resin, such as thermoplastic resin with colorant, a charge control agent, a releasing agent, etc., kneading, pulverization, and classification. Further, in order to provide fluidity and suitable electrostatic charging characteristics to the toner and to enhance the ability to clean the toner from the photosensitive drum, inorganic particulates of silica, titanium oxide, or the like are externally added to the toner base particles.

As development processes using the toner, there are known one-component development process using the toner solely as developer (one-component developer) and tow-component development process using developer obtained by mixing the toner and a carrier (two-component developer). In the two-component development process using the two-component developer, the carrier charges the toner by frictional charging and plays a role in toner conveyance. For this reason, the two-component development process has an advantage that charging characteristics and conveyability of the toner can be relatively stable in the beginning of image formation.

For the two-component developer used in the two-component development process, a carrier is used of which carrier core is covered with a coating layer formed with a coating agent, such as acrylic resin, silicone-based resin, and epoxy-based resin. However, where high coverage rate printing using two-component developer including such a carrier is performed for a long period of time, an external additive (external additive attached to toner surface or external additive separated from toner) and the carrier may abrade each other in a development device to cause the coating layer that covers the carrier core to peel off and to cause the external additive separated from the toner to adhere to the surface of the coating layer. Peeling off of the coating layer or adhesion of the external additive may lead to impairment of the power of the carrier for toner charge. Accordingly, fogging may tend to be caused in image formation using the above two-component developer.

In view of the forgoing, two-component developer has been proposed which uses a carrier covered with resin including polyamide-imide resin for the purpose of preventing the coating layer from peeling off from the carrier core. In addition, two-component developer has been proposed which includes a carrier with a coating layer to which fluororesin is added for the purpose of preventing the external additive separated from the toner from adhering to the surface of the carrier.

SUMMARY

The present disclosure provides the following.

Two-component developer according to one aspect of the present disclosure includes positively chargeable toner and a carrier. The carrier is formed of a carrier core and a coating layer that covers the carrier core. The coating layer includes one or more types of fluorine-containing resin selected from the group consisting of fluorine containing polyimide resin and fluorine containing polyamide-imide resin. The positively chargeable toner includes binder resin and a charge control agent. A content of the charge control agent is 1.0% by mass or higher and 5.0% by mass or lower relative to a mass of the toner.

DETAILED DESCRIPTION

Embodiments of the present disclosure will be described in detail below. The present disclosure is not limited to the following embodiments and can be reduced in practice with any appropriate modification within the scope of the purpose of the present disclosure. It is noted that description of duplicate parts may be omitted appropriately, which however, should not be taken to limit the present disclosure.

Two-component developer according to the present disclosure includes a carrier and positively chargeable toner. Description will be made below about the carrier, the positively chargeable toner, and a method for preparing the two-component developer.

[Carrier]

A carrier core of the carrier included in the two-component developer according to the present disclosure is covered with a coating layer. The coating layer includes one or more types of fluorine-containing resin selected from the group consisting of fluorine containing polyimide resin and fluorine containing polyamide-imide resin. Description will be made below sequentially about the carrier core that forms the carrier, the coating layer, and a method for producing the carrier.

[Carrier Core]

The type of the carrier core is not particularly limited as long as it is a carrier core for a carrier for two-component developer. Specific examples of a material for the carrier core include: particles made of a material, such as iron, iron subjected to oxidation, reduced iron, magnetite, copper, silicon steel, ferrite, nickel, and cobalt; particles of alloys of any of these materials and metal, such as manganese, zinc, and aluminum; and particles of alloy, such as an iron-nickel alloy and an iron-cobalt alloy. Alternatively, the particles may be particles of ceramics, such as titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate, or particles of a high dielectric material, such as ammonium dihydrogen phosphate, potassium dihydrogen phosphate, and Rochelle salt. Of the particles, ferrite is preferable. Further, a carrier core may be used which is made of resin in which the above particles, which are magnetic particles, are dispersed.

The average particle diameter of the carrier core is preferably 15 μm or larger and 150 μm or smaller, and more preferably 20 μm or larger and 100 μm or smaller. It is noted that each average particle diameter of the carrier core and the carrier can be measured using a laser diffraction particle size analyzer (e.g., "HELOS" by SYMPATEC GmbH) and a dry disperser ("RODOS" by SYMPATEC GmbBH) under a condition of a dispersion pressure of 3.0 bar.

The saturation magnetization of the carrier core is preferably 30 emu/g or higher and 100 emu/g or lower, and more preferably 50 emu/g or higher and 90 emu/g or lower. The use of the carrier including the carrier core with a saturation magnetization within such a range in the two-component developer can achieve formation of an image with desired image density even in continuous printing at a low coverage rate. The saturation magnetization of the carrier core can be measured using a vibrating sample magnetometer (e.g., "BHV-35H" by Riken Denshi Co., Ltd.).

The average circularity of the carrier core is preferably 0.960 or larger, more preferably 0.965 or larger, and particularly preferably 0.970 or larger. Fogging, which may be caused by impairment of the power of the carrier for toner charge, can be especially prevented in image formation using the two-component developer using the carrier including the carrier core with an average circularity in such a range.

Where the carrier core is made of an inorganic material, the average circularity of the carrier core can be adjusted by changing the production conditions, such as baking temperature and a baking period in preparing the carrier core. The longer the baking period is, or the higher the baking temperature is, the higher the average circularity of the carrier core tends to be. However, too long baking period or too high baking temperature may melt the carrier core to reduce the average circularity of the carrier core. Where the carrier core is resin carrier core, thermal treatment on the resin carrier core can increase the average circularity of the carrier core.

The average circularity of the carrier core can be measured by the following method, for example.

<Method for Measuring Average Circularity>

Using a scanning electron microscope (SEM) (e.g., "JSM-7600F" by JEOL Ltd.), 100 or more carrier cores with an equivalent circle diameter of 20 μm or larger and 60 μm or smaller are photographed at a magnification of 1000× or higher and 2000× or lower to obtain a SEM image. Image processing using an image analyzer (e.g., "Mac-View" by Mountech CO., Ltd.) is performed on an image of the carrier core particles on the obtained SEM image to measure the length ($L_0$) of the periphery of a circle having the same projection area as that of the particle image and the length (L) of the actual outer periphery of the particles. Then, each roundness of the carrier core particles is calculated using the following equation on the basis of the measured lengths $L_0$ and L.

(Equation for Roundness Calculation)

$$\text{Roundness}=L_0/L$$

[Coating Layer]

The coating layer that covers the carrier core includes one or more types of fluorine-containing resin selected from the group consisting of fluorine containing polyimide resin and fluorine containing polyamide-imide resin.

The carrier according to the present disclosure includes a coating layer including fluorine-containing resin. For this reason, its charge polarity is negative. Accordingly, the use of the carrier according to the present disclosure and positively chargeable toner for the two-component developer can achieve favorable toner charge. Image formation using such the two-component developer can reduce fogging that may be caused by impairment of the power of the carrier for toner charge. Further, the carrier of the present disclosure, which includes the coating layer including the fluorine-containing resin selected from the group consisting of fluorine containing polyimide resin and fluorine containing polyamide-imide resin, is excellent in mechanical strength and abrasion resistance. When the carrier of the present disclosure is used in the two-component developer, the coating layer can be prevented from peeling off from the carrier core. Further, the external additive separated from the toner can be prevented from adhering to the surface of the carrier.

The content of the fluorine-containing resin is preferably 1% by mass or higher and 3% by mass or lower relative to the mass of the carrier core. Where an image is formed with two-component developer including a carrier in which the content of the fluorine-containing resin is too low, the coating layer may tend to peel off. Peeling off of the coating layer may tend to cause fogging on a white portion (non-imaged portion) of an image in continuous printing. By contrast, where an image is formed with two-component developer including a carrier in which the content of the fluorine-containing resin is too high, the external additive may tend to adhere to the coating layer of the carrier, while the durability of the carrier is excellent. Adhesion of the external additive to the coating layer of the carrier may impair the power of the carrier for toner charge. This may make it difficult to form an image with desired image density.

It is noted that the coating layer may include resin that is neither fluorine containing polyimide resin nor fluorine containing polyamide-imide resin within the range not adversely affecting the purpose of the present disclosure. Description will be made below about the fluorine-containing resin (fluorine containing polyimide resin and fluorine containing polyamide-imide resin), other resin, and the mass of the coating layer.

<Fluorine-Containing Resin>

As the fluorine-containing resin, one or more types of resin are selected from the group consisting of fluorine containing polyimide resin and fluorine containing polyamide-imide resin. In order to obtain a carrier with desired performance, the content of fluorine in the fluorine-containing resin is preferably 10% by mass or higher, more preferably 20% by mass or higher, and particularly preferably 30% by mass or higher. The fluorine containing polyimide resin and the fluorine containing polyamide-imide resin will be described below.

(Fluorine Containing Polyimide Resin)

The fluorine containing polyimide resin is not particularly limited as long as it includes a fluorine atom in its structure. For example, the fluorine containing polyimide resin may be any of aliphatic polyimide resin, aliphatic-aromatic polyimide resin, and aromatic polyimide resin. The aliphatic unit included in aliphatic polyimide resin and aliphatic-aromatic polyimide resin is not limited to a chain aliphatic unit and may be an alicyclic aliphatic unit. In view of the fact that it is excellent in strength and it is easy to form a coating layer that can less peel off from the carrier core, fluorine containing polyimide resin is preferably aliphatic-aromatic polyimide resin or aromatic polyimide resin. Of these types of resin, aliphatic-aromatic polyimide resin and aromatic polyimide resin including an aromatic unit derived from aromatic tetracarboxylic acid dianhydride are preferable.

The method for producing fluorine containing polyimide resin is not particularly limited and can be appropriately selected from known methods of producing polyimide resin. For example, fluorine containing polyimide resin can be obtained by condensation by heating tetracarboxylic acid dianhydride including at least one type of fluorine containing monomer and diamine including at least one type of fluorine containing monomer. It is noted that only one of tetracarboxylic acid dianhydride and diamine for condensation may contain fluorine. The fluorine containing monomer may be included in tetracarboxylic acid dianhydride or diamine.

Description will be made below about a monomer containing no fluorine out of monomers that can be used for manufacture of fluorine containing polyimide resin. Suitable examples of the monomer containing no fluorine include aromatic tetracarboxylic acid dianhydride and diamine (aliphatic compound or aromatic compound).

Suitable examples of the aromatic tetracarboxylic acid dianhydride include pyromellitic acid dianhydride, 3,3',4,4'-benzophenonetetracarboxylic acid dianhydride, 2,2',3,3'-benzophenonetetracarboxylic acid dianhydride, 2,3,3',4-benzophenonetetracarboxylic acid dianhydride, naphthalene-2,3,6,7-tetracarboxylic acid dianhydride, naphthalene-1,2,5,6-tetracarboxylic acid dianhydride, naphthalene-1,2,4,5-tetracarboxylic acid dianhydride, naphthalene-1,4,5,8-tetracarboxylic acid dianhydride, naphthalene-1,2,6,7-tetracarboxylic acid dianhydride, 4,8-dimethyl-1,2,3,5,6,7-hexahydronaphthalene-1,2,5,6-tetracarboxylic acid dianhydride, 4,8-dimethyl-1,2,3,5,6,7-hexahydronaphthalene-2,3,6,7-tetracarboxylic acid dianhydride, 2,6-dichloronaphthalene-1,4,5,8-tetracarboxylic acid dianhydride, 2,7-dichloronaphthalene-1,4,5,8-tetracarboxylic acid dianhydride, 2,3,6,7-tetrachloronaphthalene-1,4,5,8-tetracarboxylic acid dianhydride, 1,4,5,8-tetrachloronaphthalene-2,3,6,7-tetracarboxylic acid dianhydride, 3,3',4,4'-diphenyl tetracarboxylic acid dianhydride, 2,2',3,3'-diphenyl tetracarboxylic acid dianhydride, 2,3,3',4-diphenyl tetracarboxylic acid dianhydride, 3,3",4,4"-p-terphenyl tetracarboxylic acid dianhydride, 2,2",3,3"-p-terphenyl tetracarboxylic acid dianhydride, 2,3,3",4"-p-terphenyl tetracarboxylic acid dianhydride, 2,2-bis(2,3-di-carboxyphenyl)propane dianhydride, 2,2-bis(3,4-di-carboxyphenyl)propane dianhydride, bis(2,3-di-carboxyphenyl)ether dianhydride, bis(2,3-di-carboxyphenyl)methane dianydride, bis(3,4-di-carboxyphenyl)methane dianhydride, bis(2,3-di-carboxyphenyl)sulfone anhydride, bis(3,4-di-carboxyphenyl)sulfone dianhydride, 1,1-bis(2,3-di-carboxyphenyl)ethane dianhydride, 1,1-bis(3,4-di-carboxyphenyl)ethane dianhydride, perylene-2,3,8,9-tetracarboxylic acid dianhydride, perylene-3,4,9,10-tetracarboxylic acid dianhydride, perylene-4,5,10,11-tetracarboxylic acid dianhydride, perylene-5,6,11,12-tetracarboxylic acid dianhydride, phenanthrene-1,2,7,8-tetracarboxylic acid dianhydride, phenanthrene-1,2,6,7-tetracarboxylic acid dianhydride, phenanthrene-1,2,9,10-tetracarboxylic acid dianhydride, cyclopentane-1,2,3,4-tetracarboxylic acid dianhydride, pyrazine-2,3,5,6-tetracarboxylic acid dianhydride, pyrrolidine-2,3,4,5-tetracarboxylic acid dianhydride, thiophene-2,3,4,5-tetracarboxylic acid dianhydride, and 4,4'-oxy-di-phthalic anhydride.

Suitable examples of the diamine include 3,3'-dimethyl-4,4'-diaminobiphenyl, 4,6-dimethyl-m-phenylenediamine, 2,5-dimethyl-p-phenylenediamine, 2,4-diaminomesitylene, 4,4'-methylene-di-o-toluidine, 4,4'-methylene-di-2,6-xylidine, 4,4'-methylene-2,6-diethylaniline, 2,4-toluilenediamine, m-phenylenediamine, p-phenylenediamine, 4,4'-diamino-diphenyl propane, 3,3'-diaminodiphenyl propane, 4,4'-diaminodiphenylmethane, 3,3'-diaminodiphenylmethane, 4,4'-diaminodiphenylmethane, 3,3'-diaminodiphenylmethane, 4,4'-diaminodiphenyl sulfide, 3,3'-diaminodiphenyl sulfide, 4,4'-diaminodiphenyl sulfone, 3,3'-diaminodiphenyl sulfone, 4,4'-diaminodiphenyl ether, 3,3'-diaminodiphenyl ether, benzidine, 3,3'-diaminobiphenyl, 3,3'-dimethoxybenzidine, 4,4"-diamino-p-terphenyl, 3,3"-diamino-p-terphenyl, bis(p-aminocyclohexyl)methane, bis(p-β-amino-t-butylphenyl)ether, bis(p-β-methyl-δ-aminopentyl)benzene, p-bis(2-methyl-4-aminopenthyl)benzene, p-bis(1,1-dimethyl-5-aminopenthyl)benzene, 1,5-diaminonaphthalene, 2,6-diaminonaphthalene, 2,4-bis(β-amino-t-butyl)toluene, 2,4-diaminotoluene, m-xylene-2,5-diamine, p-xylene-2,5-diamine, m-xylylenediamine, p-xylylenediamine, 2,6-diaminopyridine, 2,5-diaminopyridine, 2,5-diamino-1,3,4-oxadiazole, 1,4-diamino-cyclohexane, piperazine, methylenediamine, ethylenediamine, propylenediamine, 2,2-dimethylpropylenediamine, tetramethylenediamine, pentamethylenediamine, hexamethylenediamine, 2,5-dimethylhexamethylenediamine, 3-methoxyhexamethylenediamine, heptamethylenediamine, 2,5-dimetylheptamethylenediamine, 3-methylheptamethylenediamine, 4,4-dimethylheptamethylenediamine, octamethylenediamine, nonamethylenediamine, 5-methylnonamethylenediamine, 2,5-dimetylnonamethylenediamine, decamethylenediamine, 1,10-diamino-1,10-dimethyldecane, 2,11-diaminododecane, 1,12-diaminooctadecane, 2,17-diaminoeicosane, and 1,3-bis(3-aminophenoxy)benzene.

Suitable examples of the fluorine containing monomer include fluorine containing aromatic tetracarboxylic acid dianhydride and fluorine containing diamine (aliphatic compound or aromatic compound). Suitable examples of the fluorine containing aromatic tetracarboxylic acid dianhydride include the followings.

[Chemical formula 1]

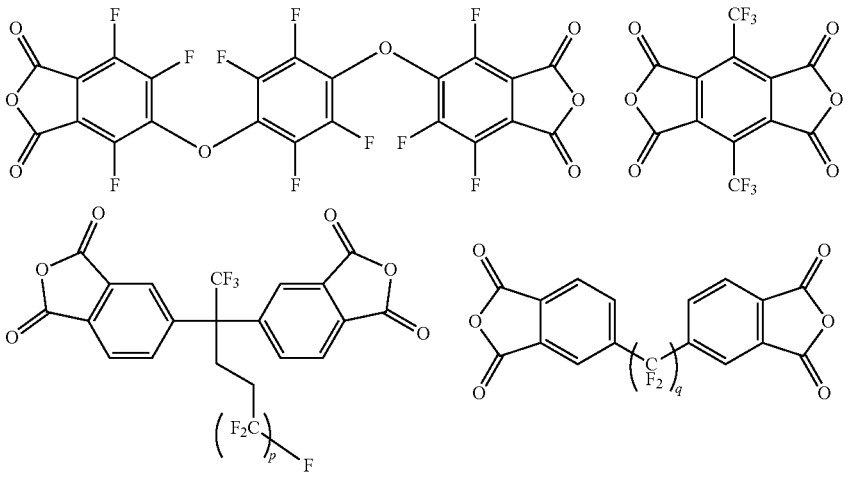

-continued
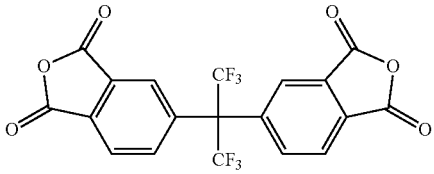
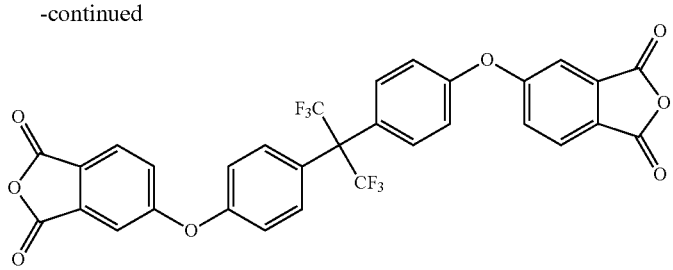
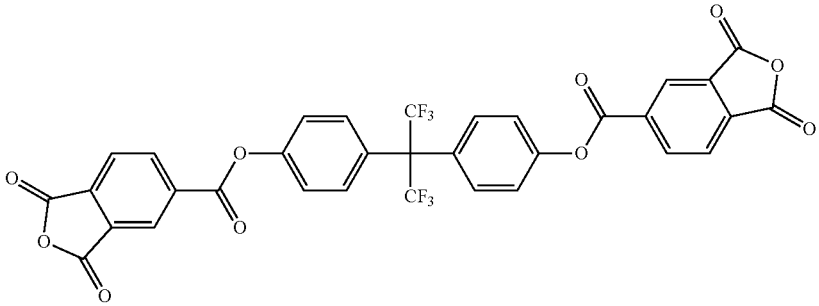
Reference characters p and q in the above chemical formula each are an integer equal to or larger than 1. Each of p and q is preferably an integer of 1 to 20, more preferably an integer of 1 to 15, and still more preferably an integer of 1 to 8.
Suitable examples of the fluorine containing diamine include the followings.
[Chemical formula 2]
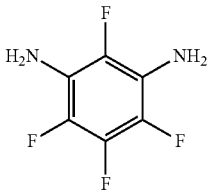
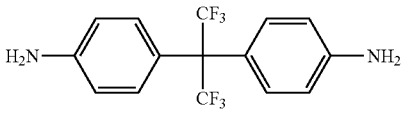
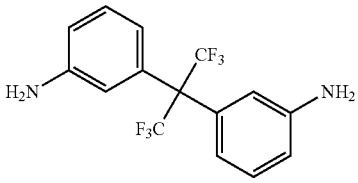
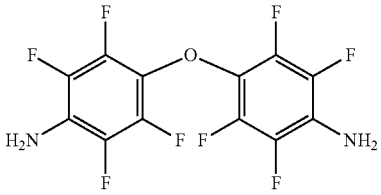
-continued
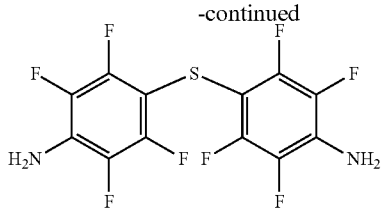
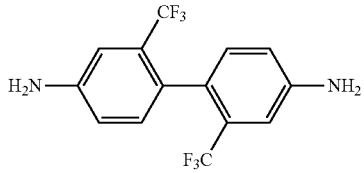
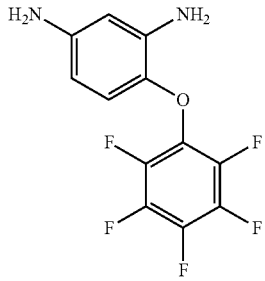
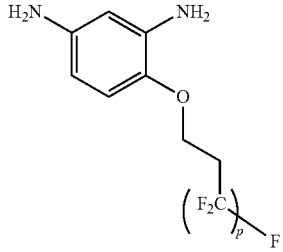

-continued

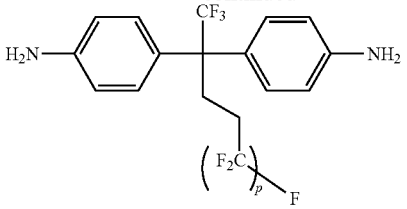

-continued

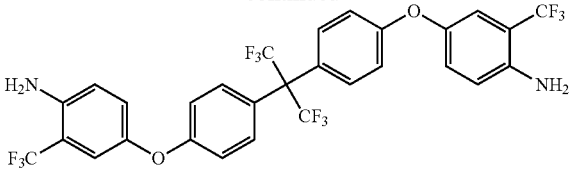

Reference character p in the above chemical formula is an integer equal to or lager than 1. Yet, p is preferably an integer of 1 to 20, more preferably an integer of 1 to 15, and still more preferably an integer of 1 to 8.

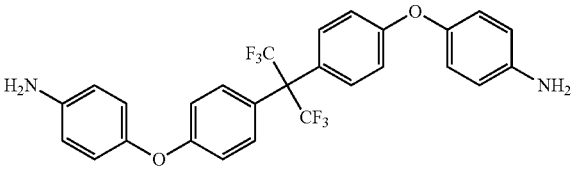

Suitable examples of fluorine containing polyimide resin synthesized using the above monomers include fully-fluorinated polyimide resin expressed by the following formulae A-1 to A-3 and partially-fluorinated polyimide resin expressed by the following formulae B-1 to B-3. It is noted that reference character n in the following formulae A-1 to A-3 and B-1 to B-3 represents the number of cycles of a unit that forms polyimide resin.

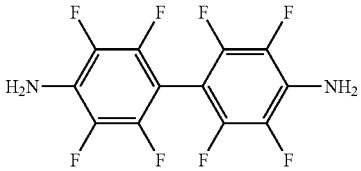

Table 1 indicates each fluorine content of the fully-fluorinated polyimide resin expressed by the following formulae A-1 to A-3 and of the partially-fluorinated polyimide resin expressed by the following formulae B-1 to B-3. The content of fluorine in the fluorine-containing resin (fully-fluorinated polyimide resin and partially-fluorinated polyimide resin) means a ratio of the sum of the molecular weight of fluorine included in the units forming the fluorine-containing resin relative to the molecular weight of the units forming the fluorine-containing resin.

[Chemical formula 3]

(A-1)

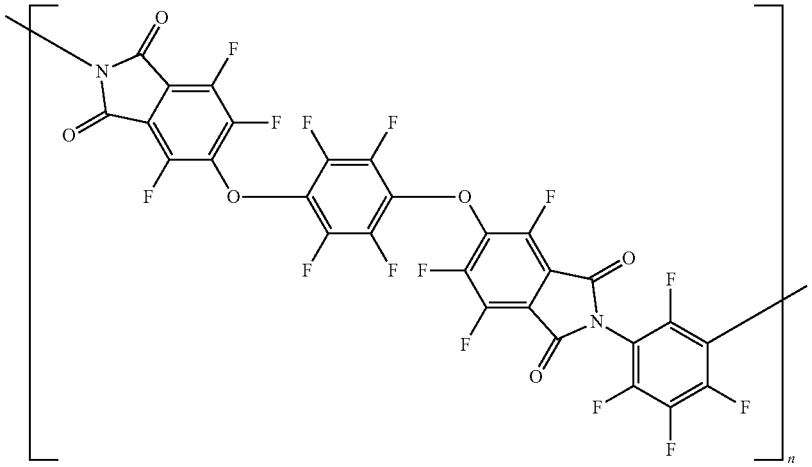

-continued
(A-2)
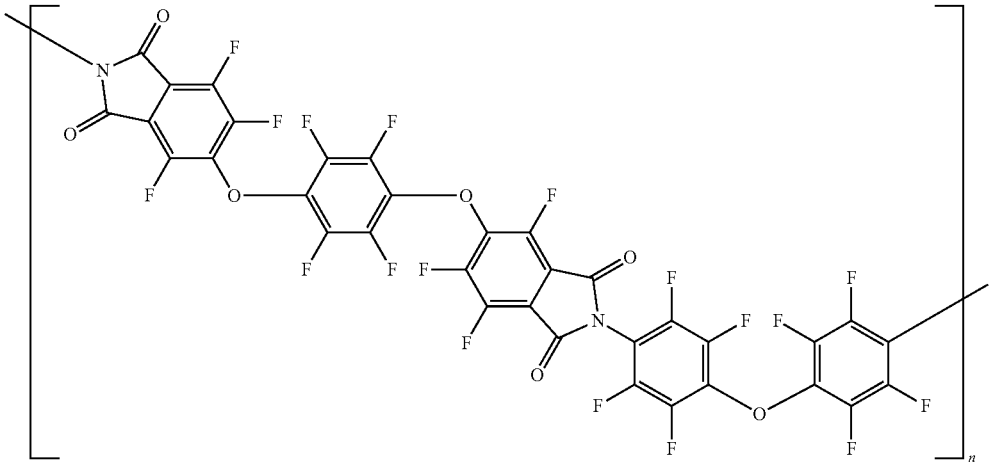
(A-3)
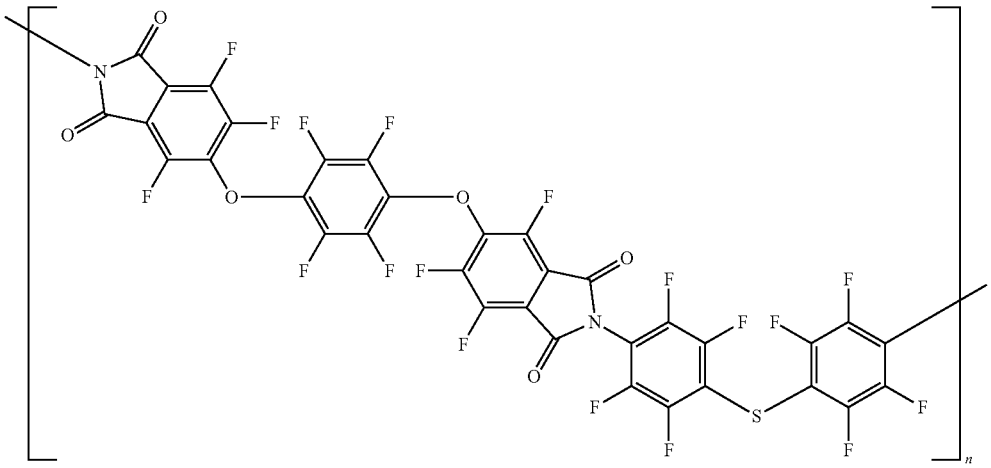
[Chemical formula 4]
(B-1)
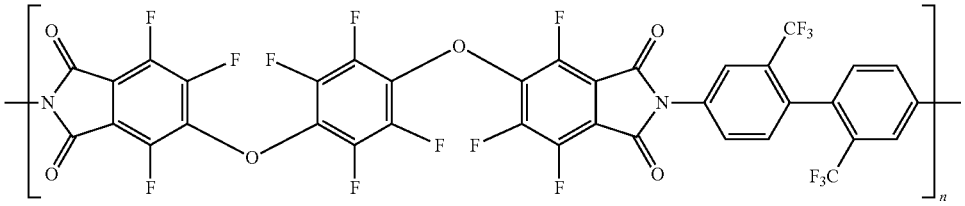
(B-2)
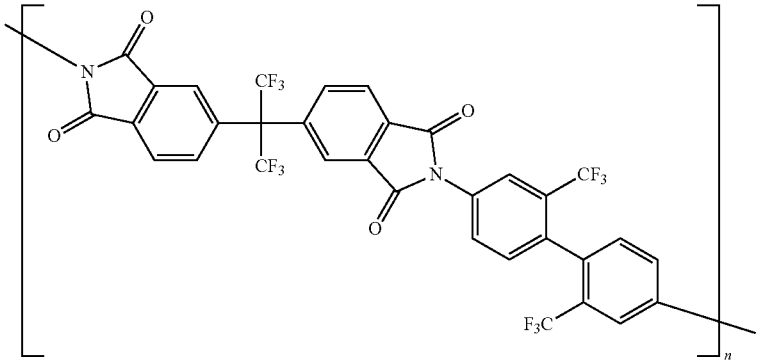

-continued (B-3)

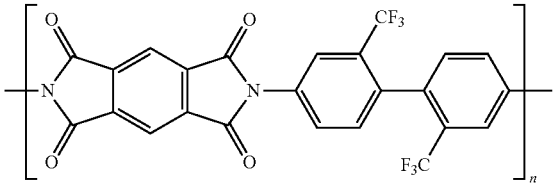

TABLE 1

| | Abbreviation | Fluorine content (% by mass) | Formula |
|---|---|---|---|
| Fully-fluorinated polyimide resin | 10FEDA/4FMPD | 36.6 | A-1 |
| | 10FEDA/8FODA | 38.4 | A-2 |
| | 10FEDA/8FSDA | 37.7 | A-3 |
| Partially-fluorinated polyimide resin | 10FEDA/TFDB | 35.1 | B-1 |
| | 6FDA/TFDB | 31.3 | B-2 |
| | PMDA/TFDB | 22.7 | B-3 |

(Fluorine Containing Polyamide-Imide Resin)

The fluorine containing polyamide-imide resin is not particularly limited as long as it includes a fluorine atom, an imide bond, and an amide bond in its structure. For example, the fluorine containing polyamide-imide resin may be any of aliphatic polyamide-imide resin, aliphatic-aromatic polyamide-imide resin, and aromatic polyamide-imide resin. The aliphatic unit included in the aliphatic polyamide-imide resin and the aliphatic-aromatic polyamide-imide resin may be a chain aliphatic unit or an alicyclic aliphatic unit. In view of the fact that it is excellent in strength and it is easy to form a coating layer that can less peel off from the carrier core, the fluorine containing polyamide-imide resin is preferably aliphatic-aromatic polyamide-imide resin or aromatic polyamide-imide resin.

The method for producing the fluorine containing polyamide-imide resin is not particularly limited and can be appropriately selected from known methods of producing polyamide-imide resin. For example, the fluorine containing polyamide-imide resin can be obtained by condensation by heating tricarboxylic acid anhydride including at least one type of fluorine containing monomer and diamine including at least one type of fluorine containing monomer. It is noted that only one of tricarboxylic acid anhydride and diamine for condensation may contain fluorine. The fluorine containing monomer may be included in tricarboxylic acid anhydride or diamine.

Description will be made below about a monomer containing no fluorine out of the monomers that can be used for manufacturing the fluorine containing polyamide-imide resin. Suitable examples of the monomer containing no fluorine include aromatic tricarboxylic acid anhydride and diamine (aliphatic compound or aromatic compound). The same diamines as those exemplified as the monomers of the fluorine containing polyimide resin can be used as the diamine (aliphatic compound or aromatic compound).

Specific examples of the aromatic tricarboxylic acid anhydride include benzenetricarboxylic acid anhydride, such as 1,2,3-benzenetricarboxylic acid anhydride and trimellitic acid anhydride (1,2,4-benzenetricarboxylic acid anhydride); naphthalenetricarboxylic acid anhydride, such as 1,2,4-naphthalenetricarboxylic acid anhydride, 1,4,5-naphthalenetricarboxylic acid anhydride, 2,3,6-naphthalenetricarboxylic acid anhydride, and 1,2,8-naphthalenetricarboxylic acid anhydride; and aromatic tricarboxylic acid anhydride, such as 3,4,4'-benzophenonetricarboxylic anhydride, 3,4,4'-biphenyl ether tricarboxylic acid anhydride, 3,4,4'-biphenyltricarboxylic acid anhydride, 2,3,2'-biphenyltricarboxylic acid anhydride, 3,4,4'-biphenylmethane tricarboxylic acid anhydride, and 3,4,4'-biphenylsulfon tricarboxylic acid anhydride.

Suitable examples of the fluorine containing monomer include fluorine containing aromatic tricarboxilic acid anhydride and fluorine containing diamine (aliphatic compound or aromatic compound). As the fluorine containing diamine (aliphatic compound or aromatic compound), the same fluorine containing diamines as those exemplified as the monomers of the fluorine containing polyimide resin can be used. Suitable examples of the fluorine containing aromatic tricarboxylic acid anhydride may be followings.

[Chemical formula 5]

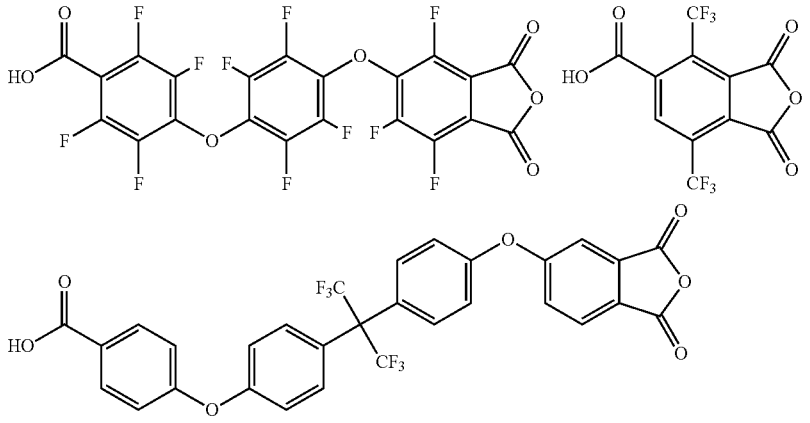

-continued

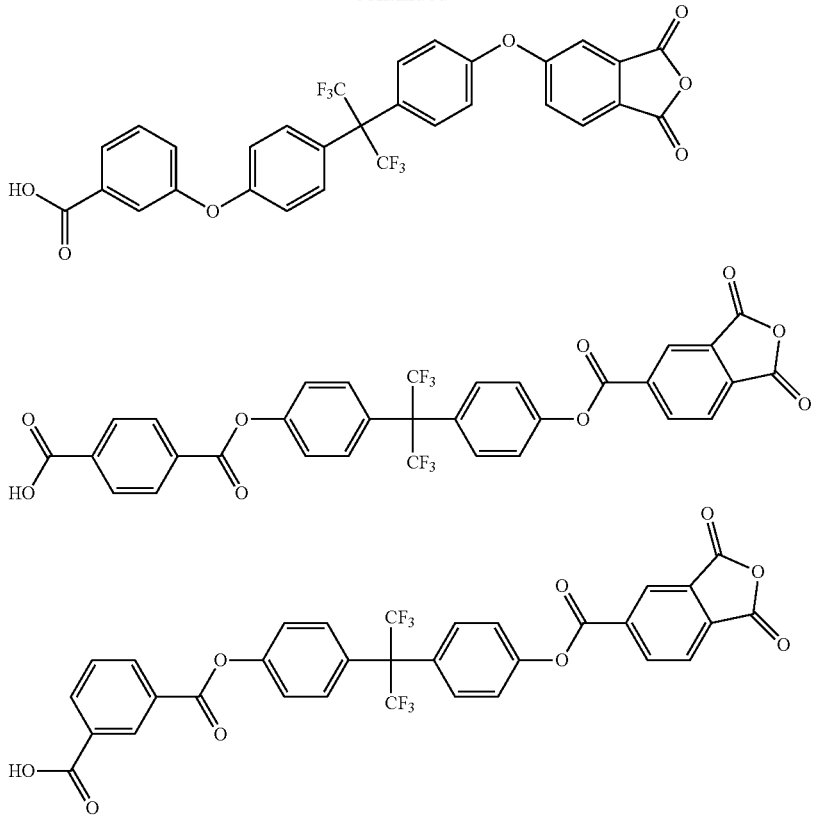

(Other Resin)

The coating layer may include resin (other resin) other than the fluorine containing polyimide resin and the fluorine containing polyamide-imide resin. For example, the coating layer may include any of aromatic polyether ketone-based resin, fluororesin, (meth)acrylic polymers, styrene-based polymers, styrene-(meth)acrylic copolymers, olefin-based polymers (polyethylene, chlorinated polyethylene, polypropylene), polyvinyl chloride, polyvinyl acetate, polycarbonate, cellulose resin, polyester resin, unsaturated polyester resin, polyurethane resin, epoxy resin, silicone resin, phenolic resin, xylene resin, diallyl phthalate resin, polyacetal resin, and amino resin. Two or more types of the resin may be used in combination.

<Mass of Coating Layer>

The content of the fluorine-containing resin in the coating layer is preferably 80% by mass or higher, more preferably 90% by mass or higher, particularly preferably 95% by mass or higher, and the most preferably 100% by mass.

[Method for Producing Carrier]

The method for covering the carrier core with the coating layer may be appropriately selected from known carrier producing methods. The method for covering the carrier core with the coating layer may be a wet method in which solution of a material for the coating layer is sprayed to the carrier core, and a solvent is then removed. Alternatively, it may be a dry method in which powder of a material for the coating layer is attached to the surface of the carrier core. Further, a combination of the wet method and the dry method may be employable, for example. That is, part of the coating layer may be formed by the wet method after the other part of the coating layer may be formed by the dry method.

(Dry Method)

An example of the dry method for covering the carrier core with powder of a material for the coating layer may be a method using a dry coating apparatus, such as a crusher with a rotor and a liner (e.g., turbo mill, pin mill, and Kriptron), a high speed mixer with an impeller, a ball mill, and an attritor.

(Wet Method)

Examples of the wet method for covering the carrier core with solution of a material for the coating layer include coating methods (e.g., immersion, spraying, and brush coating). As another coating method, a method may be such that the carrier core is allowed to flow using a fluid bed, and a material for the coating layer is sprayed to the flowing carrier core. By these coating methods, the carrier core is covered with the solution of the material for the coating layer. Thereafter, the solvent included in the solution of the material for the coating layer is removed.

Where the coating layer is formed by the wet method, examples of the solvent used in the solution of the material for the coating layer include: nitrogen containing polar solvent, such as N-methyl-2-pyrrolidone, N,N-dimethylacetamide, N,N-diethylacetamide, N,N-dimethylformamide, N,N-diethylformamide, N-methylcaprolactam, and N,N,N,N-tetramethylurea; lactone containing polar solvent, such as β-propiolactone, γ-butyrolactone, γ-valerolactone, δ-valerolactone, γ-caprolactone, and ϵ-caprolactone; dimethyl sulfoxide; acetonitrile; fatty acid esters, such as ethyl lactate, and butyl lactate; and ethers, such as diethylene glycol dimethyl ether, diethylene glycol diethyl ether, dioxane, tetrahydrofuran, methylcellosolve acetate, and ethylcellosolve acetate.

Among the above solvents, in view of high solubility in fluorine containing polyimide resin or fluorine containing polyamide-imide resin, nitrogen containing polar solvents are preferable, such as N-methyl-2-pyrrolidone, N,N-dimethylacetamide, N,N-diethylacetamide, N,N-dimethylformamide, N,N-diethylformamide, N-methylcaprolactam, and N,N,N,N-tetramethylurea. These solvents may be used solely or in combination of two or more.

As the method for producing the carrier included in the two-component developer according to the present disclosure, a method is preferable in which the coating layer including fluorine-containing resin is formed on the surface of the carrier core by the dry method. After the carrier core is covered with the coating layer, the carrier core covered with the coating layer is heated, thereby obtaining a carrier. The heating may be either external heating or internal heating. Examples of an apparatus that can be used for heating include a fluid type electric furnace, a rotary electric furnace, a burner furnace, and a thermostatic oven.

The temperature of the heating is preferably 150° C. or higher and 350° C. or lower. Further, it is preferable to set the temperature of the heating to be appropriate temperature according to the type of the resin included in the coating layer. Moreover, the time period of heating the carrier core is not particularly limited and may be preferably 5 minutes or longer and 300 minutes or shorter. Such heating advances a hardening reaction of the coating layer including fluorine-containing resin to increase the hardness of the carrier surface.

The average particle diameter of the carrier is not particularly limited within the scope not adversely affecting the purpose of the present disclosure. The average particle diameter of the carrier is preferably 15 μm or larger and 150 μm or smaller, and more preferably 20 μm or larger and 100 μm or smaller.

[Positively Chargeable Toner]

In the positively chargeable toner (hereinafter it may be referred to as merely toner) included in the two-component developer according to the present disclosure, components, such as colorant and a releasing agent may be blended with binder resin including charge control resin, as needed. Further, the toner included in the two-component developer may be one to the surface of which an external additive is attached. Description will be made below about the binder resin, the charge control agent, the colorant, the releasing agent, the external additive, and a method for producing the toner in this order.

[Binder Resin]

Specific examples of the binder resin included in the toner may be thermoplastic resin, such as styrene-based resin, acrylic resin, styrene-acrylic resin, polyethylene-based resin, polypropylene-based resin, vinyl chloride-based resin, polyester resin, polyamide resin, polyurethane resin, polyvinyl alcohol-based resin, vinyl ether-based resin, N-vinyl-based resin, and styrene-butadiene based resin. Yet, in order to increase the dispersibility of the colorant in the toner, the charging characteristics of the toner, and the fixability to paper, styrene-acrylic resin and polyester resin may be preferable. The styrene-acrylic resin and the polyester resin will be described below.

The styrene-acrylic resin is a copolymer of a styrene-based monomer and an acrylic monomer. Specific examples of the styrene-based monomer include styrene, α-methylstyrene, vinyltoluene, α-chlorostyrene, o-chlorostyrene, m-chlorostyrene, p-chlorostyrene, and p-ethylstyrene. Specific examples of the acrylic monomer include alkyl(meth)acrylate esters, such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

As the polyester resin, resin can be used which can be obtained through condensation polymerization or co-condensation polymerization of an alcohol component and a carboxylic acid component. Examples of the components used in synthesizing the polyester resin include the following divalent or trivalent or higher valent alcohol components and divalent or trivalent or higher valent carboxylic acid components.

Specific examples of the divalent or trivalent or higher valent alcohol components include diols, such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; bisphenols, such as bisphenol A, hydrogenated bisphenol A, polyoxyethylene-modified bisphenol A, and polyoxypropylene-modified bisphenol A; and trivalent or higher valent alcohols, such as, sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the divalent carboxylic acid components include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, and malonic acid. Further, still other examples of the divalent carboxylic acid components include alkyl succinic acids, such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, and isododecenylsuccinic acid, and divalent carboxylic acids, such as alkenylsuccinic acid.

Specific examples of the trivalent or higher valent carboxylic acid components include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Any of the above divalent or trivalent or higher valent carboxylic acid components may be used as a derivative for forming an ester, such as acid halide, acid anhydride, and lower alkyl ester. The term, "lower alkyl" means an alkyl group with carbon atom of 1 to 6.

Where the binder resin is polyester resin, the softening point of the polyester resin is preferably 80° C. or higher and 150° C. or lower, and more preferably 90° C. or higher and 140° C. or lower.

The binder resin is preferably thermoplastic resin in view of the fact that it can increase the fixability of the toner to paper. Further, besides sole use of thermoplastic resin, a crosslinking agent or thermosetting resin may be added to the thermoplastic resin. Introduction of a partially cross-linked structure into the binder resin can enhance properties, such as preservation stability, shape retaining property, and durability of the toner, without involving reduction in fixability of the toner to paper.

Thermosetting resin that can be used in combination with the thermoplastic resin is preferably epoxy resin or cyanate-based resin, for example. Suitable examples of the thermosetting resin include bisphenol A type epoxy resin, hydrogenated bisphenol A type epoxy resin, novolac-type epoxy resin, poly(alkylene ether)-type epoxy resin, cyclic aliphatic-type epoxy resin, and cyanate resin. Two or more of these types of thermosetting resin may be used in combination.

The glass transition point (Tg) of the binder resin is preferably 50° C. or higher and 65° C. or lower, and more preferably 50° C. or higher and 60° C. or lower. Where the grass transition point of the binder resin is too low, the toner may fuse in the interior of the development device in an image forming device. Also, the preservation stability may reduce to partially fuse the toner in transport of a toner container or storage of the toner container in a storehouse. By contrast, where the glass transition point is too high, the strength of the binder resin may reduce, which may cause the toner to tend to adhere to a latent image bearing member (image carrier: photoreceptor). In addition, where the glass transition point is too high, the toner may tend to be difficult to be favorably fixed at low temperature.

It is noted that the grass transition point of the binder resin can be obtained using a differential scanning calorimeter (DSC) from the point of variation of the specific heat of the binder resin. More specifically, the glass transition point of the binder resin can be obtained by measuring an endothermic curve of the binder resin with the use of a differential scanning calorimeter, "DSC-6200" by Seiko Instruments Inc. For example, a sample of 10 mg is put into an aluminum pan, while an empty aluminum pan is prepared as a reference. Under measurement conditions of a temperature range of 25° C. or higher and 200° C. or lower and a temperature-rising rate of 10° C./min, the endothermic curve of the binder resin is measured at normal temperature and humidity. Then, the glass transition point of the binder resin is obtained on the basis of the obtained endothermic curve of the binder resin.

[Charge Control Agent]

The positively chargeable toner included in the two-component developer according to the present disclosure includes a charge control agent in order to increase/enhance the charge level, charge rise characteristics, durability, or stability. The charge rise characteristics serves as an index as to whether or not the toner can be charged to a predetermined charge level within a short period of time. The carrier included in the two-component developer of the present disclosure, which includes the coating layer including a predetermined amount of fluorine-containing resin, is negatively chargeable. Further, the positively chargeable toner including a positively chargeable charge control agent is used in the two-component developer of the present disclosure.

The positively chargeable charge control agent can be appropriately selected from charge control agents for toner. Specific examples of the positively chargeable charge control agent include: azine compounds, such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes made of an azine compound, such as azine fast red FC, azine fast red 12BK, azine violet BO, azine brown 3G, azine light brown GR, azine dark green BH/C, azine deep black EW, and azine deep black 3RL; nigrosine compounds, such as nigrosine, nigrosine salt and nigrosine derivatives; acid dyes made of a nigrosine compound, such as nigrosine BK, nigrosine NB, and nigrosine Z; metal salts of naphthenic acid or higher fatty acid; alkoxylated amine; alkylamide; and quaternary ammonium salts, such as benzylmethylhexyldecylammonium and decyltrimethylammonium chloride. Among these positively chargeable charge control agents, quaternary ammonium salts are more preferable in view of the fact that influence to the tone of the toner is less. Examples of commercially available quaternary ammonium salts include "BONTRON P-51" and "BONTRON P-52" by ORIENT CHEMICAL INDUSTRIES CO., LTD. It is noted that two or more types of these positively chargeable charge control agents may be used in combination.

Resin with a quaternary ammonium salt, a carboxylate, or a carboxyl group as a functional group may be used as the positively chargeable charge control agent. More specific examples of the resin include styrene-based resin with a quaternary ammonium salt, acrylic resin with a quaternary ammonium salt, styrene-acrylic resin with a quaternary ammonium salt, polyester resin with a quaternary ammonium salt, styrene-based resin with a carboxylate, acrylic resin with a carboxylate, styrene-acrylic resin with a carboxylate, polyester resin with a carboxylate, styrene-based resin with a carboxyl group, acrylic resin with a carboxyl group, styrene-acrylic resin with a carboxyl group, and polyester resin with a carboxyl group. The degrees of polymerization (molecular weight) of these types of resin may be in a range of oligomer or polymer.

Among the resin that can be used as the positively chargeable charge control agent, styrene-acrylic resin with a quaternary ammonium salt as a functional group is more preferable because the charge amount can be easily adjusted within a desired range. Specific examples of preferable acrylic comonomers to be copoymirized with a styrene unit in preparing the styrene-acrylic resin with a quaternary ammonium salt as a functional group include alkyl(meth)acrylate esters, such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

Further, as the quaternary ammonium salt, a unit is used which is induced from dialkylaminoalkyl(meth)acrylate, dialkyl(meth)acrylamide, or dialkylaminoalkyl(meth)acrylamide through quaternization. Specific examples of the dialkylaminoalkyl(meth)acrylate include dimethylaminoethyl (meth)acrylate, diethylaminoethyl(meth)acrylate, dipropylaminoethyl(meth)acrylate, and dibutylaminoethyl (meth)acrylate. One specific example of dialkyl(meth)acrylamide may be dimethylmethacrylamide. One specific example of dialkylaminoalkyl(meth)acrylamide may be dimethylaminopropylmethacrylamide. Further, in polymerization, a hydroxy group including a polymerizable monomer may be used in combination, such as hydroxyethyl(meth) acrylate, hydroxypropyl(meth)acrylate, 2-hydroxybutyl (meth)acrylate, and N-methylol(meth)acrylamide.

The content of the positively chargeable charge control agent in the toner that forms the two-component developer of the present disclosure is preferably 1.0% by mass or higher and 5.0% by mass or lower, and more preferably 2.0% by mass or higher and 4.0% by mass or lower relative to the mass of the toner. Too small amount of use of the charge control agent may cause difficulty in stable charging of the positively chargeable toner to a desired charge amount. Accordingly, fogging may tend to be caused in image formation in a high temperature and high humidity environment or in long-term printing at high coverage rate. By contrast, too large amount of use of the charge control agent may cause difficulty in favorable toner charge, thereby involving difficulty in formation of an image with desired image density.

[Colorant]

The toner included in the two-component developer of the present disclosure may include colorant in the binder resin. Where the toner includes the colorant, colorant appropriately selected from known pigment or dyes can be used according to a desired color of the toner particles. Specific examples of the colorant that can be added to the toner include black pigment, such as carbon black, acetylene black, lampblack, and aniline black; yellow pigment, such as yellow lead, zinc yellow, cadmium yellow, yellow iron oxide, mineral fast yellow, nickel titanium yellow, naples yellow, naphthol yellow S, Hansa Yellow G, Hansa Yellow 10G, benzidine yellow G, benzidine yellow GR, quinoline yellow rake, permanent yellow NCG, and Tartrazine lake; orange pigment, such as orange chrome, molybdenum orange, permanent orange GTR, pyrazolone orange, Vulcan orange, and Indanthrene brilliant orange GK; red pigment, such as Indian red, cadmium red, red lead, mercury cadmium sulfide, permanent red 4R, lithol red, pyrazolone red, watching red, calcium salt, lake red D, brilliant carmine 6B, eosin lake, Rhodamine Lake B, alizarin lake, and brilliant carmine 3B; violet pigment, such as manganese violet, fast violet B, and methyl violet lake; blue pigment, such as Prussian blue, cobalt blue, alkali blue lake, partial chloride of Victorian blue, fast sky blue, and Indanthrene blue BC; green pigment, such as chrome green, chromium oxide, pigment green B, malachite green lake, and final yellow green G; white pigment, such as zinc white, titanium oxide, antimony white, and zinc sulfide; and extender pigment, such as baryta powder, barium carbonate, clay, silica, white carbon, talc, and alumina white. Two or more types of the above colorant may be used in combination for the purpose of adjusting the color phase of the toner.

The amount of use of the colorant in the present disclosure may be preferably 2 parts by mass or more and 15 parts by mass or less, and more preferably 4 parts by mass or more and 10 parts by mass or less relative to 100 parts by mass of the binder resin.

[Releasing Agent]

The toner included in the two-component developer of the present disclosure may include a releasing agent for the purpose of increasing the fixability or offset resistance. As the releasing agent added to the toner, wax is preferable. Examples of the wax include polyethylene wax, polypropylene wax, fluororesin-based wax, Fischer-Tropsch wax, paraffin wax, ester wax, montan wax, and rice wax. Two or more types of these releasing agents may be used in combination. Addition of such a releasing agent to the toner can more efficiently prevent offset or image smearing (contamination around an image by rubbing the image).

The amount of use of the releasing agent may be preferably 1 part by mass or more and 30 parts by mass or less relative to 100 mass parts by mass of the binder resin. Where the toner is produced by pulverization, which will be described later, the amount of use of the releasing agent is preferably 1 part by mass or more and 8 parts by mass or less, and more preferably 2 parts by mass or more and 5 parts by mass or less relative to 100 mass parts by mass of the binder resin. Too small amount of use of the releasing agent may result in insufficient prevention of offset or image smearing. By contrast, too large amount of use of the releasing agent may fuse the toner, which may tend to reduce the preservation stability of the toner.

[External Additive]

For the purpose of enhancing the characteristics of the toner, such as fluidity, preservation stability, or cleaning ability, an external additive may be attached to the surface of the toner. It is noted that particles before being treated with the external additive is referred to as "toner base particles" in the description of the present application.

The external additive can be appropriately selected from external additives for toner. Specific examples of a suitable external additive include metal oxides, such as alumina, titanium oxide, magnesium oxide, zinc oxide, strontium titanate, and barium titanate, and silica. Two or more of these external additives can be used in combination.

These external additives may be subjected to surface treatment using a hydrophobization agent. Examples of the hydrophobization agent include silicone oil, aminosilane, hexamethyldisilazane, titanate-based coupling agents, and silane-based coupling agents. In order to prevent abrasion of the carrier surface, it is preferable to use hydrophobic silica subjected to surface treatment using a hydrophobic treatment agent with an amino group. Examples of the hydrophobic treatment agent with an amino group include aminosilane, hexamethyldisilazane, titanate-based coupling agents with an amino group, and silane-based coupling agents with an amino group.

The particle diameter of the external additive may be preferably 0.01 μm or larger and 1.0 μm or smaller.

The amount of use of the external additive added to the toner may be 0.1 parts by mass or more and 10 parts by mass or less, and more preferably 0.2 parts by mass or more and 5 parts by mass or less relative to 100 parts by mass of the toner. The use of the external additive of an amount within such a range can easily obtain toner excellent in fluidity, preservation stability, or cleaning ability.

[Method for Producing Toner]

The method for producing the toner included in the two-component developer according to the present disclosure is not particularly limited. Examples of a suitable method may be pulverization and aggregation. In the crushing, the binder resin and an optional component, such as the colorant, the charge control agent, and the releasing agent are mixed together, and the obtained mixture is melted and kneaded using a melt-kneader, such as an extruder with a single shaft or two shafts, followed by pulverization and classification of the melted and kneaded substance, thereby obtaining toner particles (toner base particles). In the aggregation, after particulates of a component contained in the toner, such as the binder resin, the releasing agent, and the colorant are allowed to aggregate in an aqueous medium to obtain aggregated particles, the aggregated particles is heated to coalesce the components contained in the aggregated particles, thereby obtaining toner particles (toner base particles). The average particle diameter of the toner particles may be preferably 5 μm or larger and 10 μm or smaller.

The surfaces of the toner base particles thus obtained may be subjected to treatment using an external additive, as needed. The method for external addition is not particularly limited and can be selected from known external addition methods. Specifically, a condition of the treatment is adjusted so that particles of the external additive are not embedded in the toner base particles. Further, the external addition is performed using mixer, such as a Henschel mixer and a Nauta mixer.

[Method for Producing Two-Component Developer]

A suitable example of a method for producing the two-component developer is such that the toner and the carrier are mixed together using a mixer, such as a ball mill. The content of the toner in the two-component developer is preferably 1% by mass or higher and 20% by mass or lower, and more preferably 3% by mass or higher and 15% by mass or lower relative to the mass of the two-component developer. Setting the content of the toner in the two-component developer to be in such a range can maintain appropriate image density and can reduce contamination by the toner in the interior of an image forming apparatus, which is caused by tonner scattering from a development device, or adhesion of the toner to transfer paper.

By using the above described two-component developer of the present disclosure, fogging in image formation in a high temperature and high humidity environment or in long term printing can be reduced. Further, by using the two-component developer of the present disclosure, peeling off of the coating layer that covers the carrier core and adhesion of the external additive separated from the toner to the coating layer can be reduced, in long term printing. The two-component developer of the present disclosure can be suitably used in various types of image forming apparatuses that employ two-component development process.

EXAMPLES

The present disclosure will be described further in detail below by referring to the following examples. It is noted that the present disclosure is not limited by the following examples.

Preparation Example 1

(Preparation of Coating Layer Resin A-1)

As resin A-1 for the coating layer, fully-fluorinated polyimide resin formed of the unit expressed by the aforementioned formula (A-1) was prepared by the following manner.

To 86 g of N,N-dimethylacetamide (DMAc) put in an Erlenmeyer flask, 11.644 g (20.0 mmol) of 1,4-bis(3,4-dicarboxy-2,5,6-trifluorophenoxy)-2,3,5,6-tetrafluorobenzene dianhydride (10FEDA) as a monomer and 3.602 g (20.0 mmol) of 2,4,5,6-tetrafluoro-1,3phenylenediamine (4FMPD) as a monomer were added, thereby obtaining DMAc solution of the monomers. Then, the DMAc solution was stirred for 7 days at room temperature in a nitrogen atmosphere, thereby obtaining DMAc solution of fully-fluorinated polyamide acid. Next, the DMAc solution of fully-fluorinated polyamide acid was spin coated on an aluminum plate and was heated in a nitrogen atmosphere at a temperature of 70° C. for 2 hours, at a temperature of 160° C. for one hour, at a temperature of 250° C. for 30 minutes, and at a temperature of 350° C. for 1 hour in this order to imidize the fully-fluorinated polyamide acid. Then, the fully-fluorinated polyimide resin on the aluminum plate was immersed in 10% hydrochloric acid aqueous solution together with the aluminum plate to dissolve the aluminum plate, thereby obtaining a film of the fully-fluorinated polyimide resin.

The obtained film of the fully-fluorinated polyimide resin was pulverized using a pulverizing apparatus, thereby obtaining particulates of coating layer resin A-1 (fully-fluorinated polyimide resin), which was formed of the unit expressed by the following formula. The average particle diameter of the coating layer resin A-1 was about 10 μm. It is noted that reference character n in the following formula is the number of repetition of the unit.

[Chemical formula 6]

(A-1)

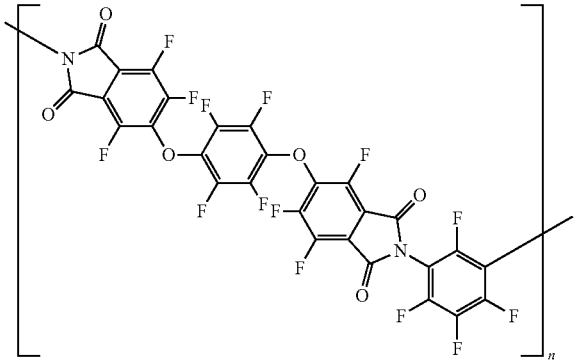

(Preparation of Coating Layer Resin B-1)

By the same method as the method for preparing the coating layer resin A-1, except that the amount of use of N,N-dimethylacetamide (DMAc) was 104 g and 11.644 g (20.0 mmol) of 1,4-bis(3,4-dikarobxy-2,5,6-trifluorophenoxy)-2,3,5,6-tetrafluoro benzene dianhydride (10FEDA) and 6.405 g (20.0 mmol) of 2,2'-bis(trifluoromethyl)-4,4'-diaminobiphenyl (TFDB) were used as monomers, particulates of coating layer resin B-1 (partially fluorinated polyimide resin) formed of the unit expressed by the following formula were obtained. The average particle diameter of the coating layer resin B-1 was about 10 μm. It is noted that reference character n in the following formula is the number of repetition of the unit.

[Chemical formula 7]

(B-1)

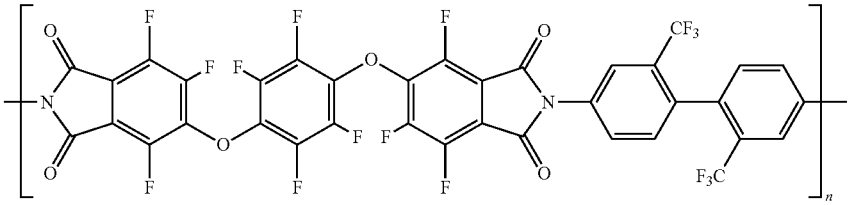

Examples 1-10 and Comparative Examples 1-11

(Preparation of Toner)

According to the following methods, toner used for preparing respective two-component developer of Examples 1-10 and Comparative Examples 1-11 was prepared.

100 parts by mass of polyester resin (copolymer of bisphenol A and fumaric acid) as the binder resin, 5 parts by mass of carbon black ("MA-100" by Mitsubishi Chemical Corporation) as the colorant, the amounts listed in Tables 2-4 of a quaternary ammonium salt compound ("BONTRON P-51" by ORIENT CHEMICAL INDUSTRIES CO., LTD.) as the charge control agent, and 5 parts by mass of carnauba wax ("Carnauba Wax No. 1" by S. KATO & CO.) as the releasing agent were mixed together using a Henschel mixer (by Mitsui Mining Co., Ltd.). Next, the obtained mixture was melted and kneaded using an extruder with two shafts (by TOSHIBA MACHINE CO., LTD.), thereby obtaining a kneaded mixture. Subsequently, the obtained kneaded mixture was cooled, was roughly pulverized using a Hammer mill (by Hosokawa Micron Corporation), and then was pulverized using a mechanical pulverizer ("Turbo Mill" by FREUND-TURBO CORPORATION). Thereafter, the obtained pulverized substance was classified using an air flow type classifier ("Elbow jet" by Nittetsu Mining Co., Ltd.), thereby obtaining toner base particles with a volume average particle diameter ($D_{50}$) of 6.8 μm.

100 parts by mass of the obtained toner base particles, 1 part by mass of hydrophobic silica ("TG-820" by Cabot Corporation: silica subjected to surface treatment with hexamethyldisilazane (HMDZ) and cyclic silazane), and 1 part by mass of titanium oxide ("EC-100" by Titan Kogyo, Ltd.) were mixed together under a condition of 30 m/sec. for 5 minutes using a Henschel mixer ("FM-10L" by NIPPON COKE & ENGINEERING CO., LTD.), thereby obtaining respective toner.

(Preparation of Carrier)

According to the following method, carriers used for preparing the respective two-component developer of Examples 1-10 and Comparative Examples 1-11 were prepared.

100 parts by mass of a carrier core ("EF-35" by Powdertech Co., Ltd.: non-coated ferrite carrier with a volume average particle diameter of 40 μm, a saturation magnetization of 68 emu/g, and an average circularity of 0.975), and 1.5 parts by mass of respective types of particulates for the coating layer resin listed in Tables 2-4 were subjected to treatment using an attritor by NIPPON COKE & ENGINEERING CO., LTD. for 5 hours to cover the carrier core with coating resin. Next, the carrier core covered with the coating resin was subjected to thermal treatment at a temperature of 300° C. for one hour using a heat treatment apparatus (a thermostatic oven by ESPEC Corp.), thereby obtaining respective carriers in which the coating layer is formed on the surfaces of the carrier core particles.

It is noted that a mixture, which was obtained by mixing polytetrafluoroethylene resin (PTFE) particulate ("L-173" by ASAHI GLASS CO., LTD.) and polyamide-imide resin particulate (TORLON 400TF" by Solvay Specialty Polymers Japan K.K.) together at a mass ratio of 1:1, was used as coating layer resin D.

(Preparation of Two-Component Developer)

The respective carriers and the respective toner were introduced to a ball mill ("Universal Ball Mill Model UB32" by Yamato Scientific Co., Ltd.) so that the mass rate of the toner to the two-component developer was 10% by mass. Then, the respective carriers and the respective toner were mixed together using the ball mill, thereby obtaining respective two-component developer of Examples 1-10 and Comparative Examples 1-11.

<<Evaluation>>

Performed on the respective two-component developer of Examples 1-10 and Comparative Examples 1-11 were evaluation of fog density in a high temperature and high humidity environment and evaluation by a continuous printing test at a coverage rate of 20% (evaluation of image density, fog density, and durability of each carrier after continuous 200000-page image formation). Evaluation results are listed in Tables 2-4. It is noted that a multifunctional peripheral ("TASKalfa 500ci" by KYOCERA Document Solutions Inc.) was used as an evaluation apparatus. The fog density was obtained as a difference between an image density at a portion with the highest image density in each obtained image on white paper and an image density of base paper (recording medium before image formation).

<In High Temperature and High Humidity Environment>

(Fog Density)

Images for evaluation at a coverage rate of 5% were obtained using the evaluation apparatus in an environment of 32.5° C. and 80% RH. Subsequently, the image density of a non-imaged portion in each recording medium on which an image evaluation pattern for evaluation was formed was measured using a spectrophotometer ("SPM50" by GretagMacbeth). Then, the fog density was evaluated with reference the following references. Marks Good and Normal were OK.

Good: 0.010 or lower

Normal: exceeding 0.010 and 0.030 or lower

Bad: exceeding 0.030

<After Continuous 200000-Page Image Formation>

(Image Density)

After continuous 200000-page image formation using the evaluation apparatus at a coverage rate of 20% in an environment of 23° C. and 50% RH, various evaluation patterns were formed on a recording medium, thereby obtaining evaluation images. The image density of each solid image in the evaluation patterns after the continuous 200000-page image formation was measured using a spectrophotometer ("SPM50" by GretagMacbeth). Then, the image density was evaluated with reference to the following references. Marks Good and Normal were OK.

Good: 1.30 or higher

Normal: 1.00 or higher and below 1.30

Bad: below 1.00

(Fog Density)

The image density of a non-imaged portion in each recording medium (recording medium on which the evaluation patterns were formed after 200000-page image formation) obtained in the evaluation of image density was measured using a spectrophotometer ("SPM50" by GretagMacbeth). The fog density was evaluated with reference to the following references. Marks Good and Normal were OK.

Good: 0.010 or lower

Normal: exceeding 0.010 and 0.030 or lower

Bad: exceeding 0.030

(Durability)

Each carrier was taken out from the development device after the 100000-page image formation and after the 200000-page image formation in the evaluation of the image density. Each carrier thus obtained after the 100000-page image formation and after the 200000-page image formation was observed using a scanning electron microscope (SEM) ("JSM-7600F" by JEOL Ltd.). The surfaces of 100 arbitrary carrier particles of the respective carrier particles were observed at a magnitude of 1000× or more and 5000× or less. Then, the durability of the respective carrier particles was evaluated with reference to the following references. It is noted that in order to check peeling off of the coating layer and adhesion of the external additive of the toner to the surface of the carrier particles, atom mapping was also performed using an X-ray spectrometer included in the scanning electron microscope as an auxiliary of the observation.

Good: neither peeling off of the coating layer nor adhesion of the external additive was observed Bad: either peeling off of the coating layer or adhesion of the external additive was observed. .

TABLE 2

| | | Comparative Example 1 | Example 1 | Example 2 | Example 3 | Example 4 | Example 5 | Comparative Example 2 |
|---|---|---|---|---|---|---|---|---|
| Toner | | | | | | | | |
| Charge control agent | | | | | | | | |
| Amount of use [% by mass] | | 0.5 | 1 | 2 | 3 | 4 | 5 | 6 |
| Carrier | | | | | | | | |
| Coating layer resin | | | | | | | | |
| Type | | | | | A-1 | | | |
| Amount of use [% by mass] | | | | | 1.5 | | | |
| Evaluation | | | | | | | | |
| High temperature & high humidity environment 32.5° C. & 80% RH | Fog density | 0.06 | 0.010 | 0.009 | 0.009 | 0.008 | 0.009 | 0.009 |
| | Evaluation | Bad | Normal | Normal | Normal | Normal | Normal | Normal |
| After 200000-page image formation 23° C. 50% RH | Image density | 1.49 | 1.48 | 1.42 | 1.38 | 1.33 | 1.18 | 0.95 |
| | Evaluation | Good | Good | Good | Good | Good | Normal | Bad |
| | Fog density | 0.055 | 0.010 | 0.008 | 0.005 | 0.005 | 0.004 | 0.003 |
| | Evaluation | Bad | Good | Good | Good | Good | Good | Good |
| | durability | Good | Good | Good | Good | Good | Good | Good |
| Total evaluation | | Bad | Good | Good | Good | Good | Normal | Bad |

TABLE 3

| | | Comparative Example 3 | Example 6 | Example 7 | Example 8 | Example 9 | Example 10 | Comparative Example 4 |
|---|---|---|---|---|---|---|---|---|
| Toner | | | | | | | | |
| Charge control agent | | | | | | | | |
| Amount of use [% by mass] | | 0.5 | 1 | 2 | 3 | 4 | 5 | 6 |
| Carrier | | | | | | | | |
| Coating layer resin | | | | | | | | |
| Type | | | | | B-1 | | | |
| Amount of use [% by mass] | | | | | 1.5 | | | |
| Evaluation | | | | | | | | |
| High temperature & high humidity environment 32.5° C. & 80% RH | Fog density | 0.085 | 0.028 | 0.01 | 0.009 | 0.008 | 0.008 | 0.009 |
| | Evaluation | Bad | Normal | Good | Good | Good | Good | Good |
| After 200000-page image formation 23° C. 50% RH | Image density | 1.53 | 1.50 | 1.48 | 1.42 | 1.38 | 1.28 | 0.99 |
| | Evaluation | Good | Good | Good | Good | Good | Normal | Bad |
| | Fog density | 0.073 | 0.020 | 0.008 | 0.005 | 0.005 | 0.004 | 0.003 |
| | Evaluation | Bad | Normal | Good | Good | Good | Good | Good |
| | durability | Good | Good | Good | Good | Good | Good | Good |
| Total evaluation | | Bad | Normal | Good | Good | Good | Normal | Bad |

TABLE 4

| | Comparative Example 5 | Comparative Example 6 | Comparative Example 7 | Comparative Example 8 | Comparative Example 9 | Comparative Example 10 | Comparative Example 11 |
|---|---|---|---|---|---|---|---|
| Toner | | | | | | | |
| Charge control agent | | | | | | | |
| Amount of use [% by mass] | 0.5 | 1 | 2 | 3 | 4 | 5 | 6 |
| Carrier | | | | | | | |
| Coating layer resin | | | | | | | |
| Type | | | | D | | | |
| Amount of use [% by mass] | | | | 1.5 | | | |

TABLE 4-continued

| | | Comparative Example 5 | Comparative Example 6 | Comparative Example 7 | Comparative Example 8 | Comparative Example 9 | Comparative Example 10 | Comparative Example 11 |
|---|---|---|---|---|---|---|---|---|
| Evaluation | | | | | | | | |
| High temperature & high humidity environment 32.5° C. & 80% RH | Fog density | 0.250 | 0.192 | 0.101 | 0.025 | 0.015 | 0.010 | 0.009 |
| | Evaluation | Bad | Bad | Bad | Normal | Normal | Good | Good |
| After 200000-page image formation 23° C. 50% RH | Image density | 1.60 | 1.55 | 1.48 | 1.40 | 1.28 | 0.98 | 0.88 |
| | Evaluation | Good | Good | Good | Good | Normal | Bad | Bad |
| | Fog density | 0.163 | 0.101 | 0.04 | 0.01 | 0.008 | 0.006 | 0.006 |
| | Evaluation | Bad | Bad | Bad | Normal | Normal | Good | Normal |
| | durability | Bad | Bad | Bad | Bad | Bad | Bad | Bad |
| Total evaluation | | Bad | Bad | Bad | Bad | Bad | Bad | Bad |

Each two-component developer in Examples 1-10 includes the positively chargeable toner, which includes the binder resin and the charge control agent, and a carrier, of which carrier core is covered with the coating layer. In each two-component developer in Examples 1-10, the coating layer includes fluorine containing polyimide resin, and the content of the charge control agent is 1.0% by mass or higher and 5.0% by mass or lower relative to the mass of the toner. With each two-component developer in Examples 1-10, fogging can be reduced in image formation in a high temperature and high humidity environment and in long term printing (see Tables 2-4). Further, with each two-component developer in Examples 1-10, peeling off of the coating layer that covers the carrier core and adhesion of the external additive separated from the toner to the coating layer might be able to be reduced in long term printing.

The evaluation results of Comparative Examples 1 and 3 (see Tables 2 and 3) prove that in image formation using the two-component developer including the toner in which the content of the charge control agent is too small, even when the carrier core is covered with the coating layer including the fluorine containing polyimide resin, fogging tends to be caused in a white portion (non-imaged portion) formed in the high temperature and high humidity environment and a white portion (non-imaged portion) after continuous printing.

The evaluation results of Comparative Examples 2 and 4 (see Tables 2 and 3) prove that even when the carrier, of which the carrier core is covered with the coating layer including the fluorine containing polyimide resin, is used, it is difficult to form an image with desired image density in image formation using the two-component developer which includes the positively chargeable toner in which the content of the charge control agent is excessive.

The evaluation results of Comparative Examples 5-11 (see Table 4) prove that peeling off of the coating layer or adhesion of the external additive of the toner to the coating layer tends to be caused in image formation using the two-component developer including the carrier of which carrier core is covered with the coating layer made of a mixture of fluorine-containing resin, which is neither polyimide resin nor polyamide-imide resin, and polyamide-imide resin.

The evaluation results of Comparative Examples 6 and 7 (see Table 4) prove that even when the content of the charge control agent in the toner is 1.0% by mass or higher and 5.0% by mass or lower relative to the mass of the toner, fogging tends to be caused in a white portion (non-imaged portion) formed in a high temperature and high humidity environment and in a white portion (non-imaged portion) after continuous printing in image formation using the two-component developer including the carrier of which carrier core is covered with the coating layer made of a mixture of fluorine-containing resin, which is neither polyimide resin nor polyamide-imide resin, and polyamide-imide resin.

The evaluation results of Comparative Example 10 (see Table 4) prove that even when the content of the charge control agent in the toner is 1.0% by mass or higher and 5.0% by mass or lower relative to the mass of the toner, an image with desired image density is difficult to be formed in image formation using the two-component developer including the carrier of which carrier core is covered with the coating layer made of a mixture of fluorine-containing resin, which is neither polyimide resin nor polyamide-imide resin, and polyamide-imide resin.

What is claimed is:

1. Two-component developer comprising positively chargeable toner and a carrier, wherein the carrier is formed of a carrier core and a coating layer that covers the carrier core, the coating layer includes fluorine containing polyamide-imide resin, the fluorine containing polyamide-imide resin is a condensate of tricarboxylic acid anhydride including at least one type of fluorine containing monomer and diamine including at least one type of fluorine containing monomer, the positively chargeable toner includes binder resin and a charge control agent, and a content of the charge control agent is 1.0% by mass or higher and 5.0% by mass or lower relative to a mass of the toner.

2. Two-component developer according to claim 1, wherein the charge control agent contains a quaternary ammonium salt.

3. Two-component developer according to claim 2, wherein the charge control agent includes styrene-acrylic resin with a quaternary ammonium salt as a functional group.

4. Two-component developer according to claim 1, wherein a content of the charge control agent is 2.0% by mass or higher and 4.0% by mass or lower relative to a mass of the toner.

5. Two-component developer according to claim 1, wherein a content of the positively chargeable toner is 1% by mass or higher and 20% by mass or lower relative to a mass of the two-component developer.

* * * * *